US006279651B1

(12) United States Patent
Schwendemann et al.

(10) Patent No.: US 6,279,651 B1
(45) Date of Patent: Aug. 28, 2001

(54) TOOL FOR MANAGING FLUID FLOW IN A WELL

(75) Inventors: Kenneth L. Schwendemann, Lewisville; Darrin N. Towers, Carrollton, both of TX (US)

(73) Assignee: Halliburton Energy Services, Inc., Dallas, TX (US)

( * ) Notice: Subject to any disclaimer, the term of this patent is extended or adjusted under 35 U.S.C. 154(b) by 0 days.

(21) Appl. No.: 09/357,144

(22) Filed: Jul. 20, 1999

(51) Int. Cl.[7] ..... E21B 43/00
(52) U.S. Cl. ..... 166/54.1; 166/66.4; 166/66.5
(58) Field of Search ..... 166/54.1, 66.5, 166/66.4, 265, 244.1, 369, 373

(56) References Cited

U.S. PATENT DOCUMENTS 4,185,541 * 1/1980 Milberger et al. .
4,275,795 * 6/1981 Beimgraben et al. .

* cited by examiner

*Primary Examiner*—Roger Schoeppel
(74) *Attorney, Agent, or Firm*—Paul I. Herman; E. Harry Gilbert, III

(57) ABSTRACT

A tool and method for managing fluid flow in a well use flow control and monitoring functions. A particular tool provides valve and metering functions combined with electrical generator and pump functions. Two of these tools can be used such that one generates electricity downhole to power the other tool to operate as a pump or other flow control. A method of managing fluid flow in a well includes operating the tool in either a generator mode or a pump mode. The tool, which is a flow control device, has a body in which an opening is defined between an annulus outside the body and a flow channel inside. The tool also has a flow control body, a rotor and electromagnetic members. A method includes moving the flow control body, the rotor, and the electromagnetic members together to selectively block or unblock the opening. In a particular version of this method, this movement is axially within the body of the flow control device. A method also includes: producing a fluid from a subterranean formation into the well; separating, in the well, water from hydrocarbons of the fluid; and reinjecting, from within the well, the separated water. Another definition of the method includes generating electricity in the well and operating a pump in the well with the electricity.

17 Claims, 2 Drawing Sheets

TOOL FOR MANAGING FLUID FLOW IN A WELL

BACKGROUND OF THE INVENTION

This invention relates generally to tools and methods for managing fluid flow in wells, particularly oil or gas wells. A particular implementation of the tool of the invention is a unitary flow control device that can function as a valve, a fluid flow sensor and meter, an electrical generator, and a pump.

In the oil and gas industry, well and reservoir management is an important aspect of efficient and economical production of oil and gas. Fluid flow, such as of the oil and gas being produced, needs to be monitored and controlled. There are various flow sensing devices, flow metering devices and valves used in downhole pipe or tubing strings to perform these functions. With changes in the industry, however, there is the need for improved tools and methods.

One of these changes is that more complex wells are being drilled. For example, horizontal wells and wells with multiple lateral bores extending from a main borehole are being drilled to improve hydrocarbon recovery rates at reduced cost relative to drilling multiple individual vertical wells.

Another of these changes is that more and more control is being put downhole to improve recovery to cost ratios. A presently evolving area uses intelligent tools applying microprocessor and computer technology in the borehole. These and other types of tools require some source of electricity to operate. Typically these sources have included power generating equipment at the surface with wireline connections to the downhole tool or self-contained downhole sources such as batteries contained in the tools themselves. To provide another source, there is the need for a downhole generator that is powered by a well's own flowing fluid.

As a specific situation arising in well and reservoir management, consider an oil or gas well having a main borehole from which several lateral boreholes extend. In this, as with other structural types of oil or gas wells, undesirable water may be produced with desired hydrocarbons. The water needs to be separated from the hydrocarbons, and in at least some instances, injected back into the well or into a disposal well. This typically requires producing the entire stream to the surface from which the well has been drilled (or to a platform or other watersurface facility for offshore wells), separating the water from the hydrocarbons at the surface, and then returning the separated water to the well or to another well. It would be desirable to be able to do this separating and reinjecting downhole to save the time and expense of producing the water all the way to the surface and then returning it back into the ground. Additionally, if the water could be separated and left downhole, more hydrocarbons could be produced in the volume previously occupied by the water. This might also obviate the necessity of having separator equipment at the surface and of having a separate injection well or other water disposal system. Accordingly, there is the specific need for an improved tool and method with which to perform downhole water separation and reinjection. More generally, there is the need for an improved tool and method that can be used downhole to control and monitor fluid flow. There is also the need for such a tool to have the capability of generating electricity in response to fluid flow in a well, such that the electricity can be used in the control aspect as needed, for example.

SUMMARY OF THE INVENTION

The present invention meets, the aforementioned needs by providing a novel and improved tool and method for managing fluid is flow in a well. The tool and method can be used downhole in a well to control and monitor fluid flow, such as could be used in reinjecting water downhole. The present invention can also be used to generate electricity downhole in response to fluid flowing in a well.

The present invention combines flow control and monitoring functions. A particular implementation of the tool of the present invention provides valve and metering functions combined with electrical generator and pump functions. Two such tools can be used such that one generates electricity downhole to power the other tool to operate as a pump. For example, one tool can be used in one flow zone of the well to generate electricity in response to fluid flow in that zone, and the electricity from that tool used to power the other tool located in another flow zone in which water is to be reinjected into the formation. That power can also be used to control flow and do reservoir evaluation on another zone. As other non-limiting examples, the present invention can be used in horizontal well sections to keep water contact from propagating down a selected length of the horizontal section, and it can be used to create a back pressure in one well section while drawing down in another section. Of course, a single multi-function tool of the present invention can be used alone in any of its modes, whether as a valve, a meter, a generator, or a pump; and two or more tools can be used to work together such as suggested above in the examples of two tools of the present invention. Thus, the present invention has advantages apparent from the foregoing.

The tool of the present invention generally comprises an outer body having an opening defined in a side wall of the body. A flow control body is disposed in the outer body such that the flow control body is movable between a closed position blocking the opening in the outer body and an open position unblocking the opening in the outer body (the blocking/unblocking being anywhere between fully blocked and fully unblocked). A rotor is connected to the flow control body and disposed in the outer body such that the rotor can rotate within the outer body in response to a force applied to the rotor. The tool can also include an actuator disposed in the outer body to move the flow control body linearly between the closed position and the open position. In a particular implementation, the rotor moves linearly with the flow control body and the flow control body rotates with the rotor. There can also be suitable seals as needed.

The present invention also provides a method of managing fluid flow in a well in which a flow control device is located, the flow control device having a body in which an opening is defined between an annulus outside the body and a flow channel inside the flow control device, and the flow control device also having a rotor and a plurality of electromagnetic members. The method comprises operating the flow control device in either a generator mode or a pump mode.

The method of managing fluid flow in a well can also be defined as moving the flow control body, the rotor, and the electromagnetic members together to selectively block or unblock the opening. In a particular version of this method, the flow control body, the rotor, and the electromagnetic members are moved axially within the body of the flow control device. For example, this can include energizing a motor coupled in the flow control device to the flow control body, the rotor, and the electromagnetic members. As another example, this can include applying to the flow control body, the rotor, and the electromagnetic members a longitudinal mechanical force originated outside the flow control device.

The present invention also provides a method of managing fluid flow in a well defined as comprising: producing a fluid from a subterranean formation into the well, the fluid including hydrocarbons and water; separating, in the well, water from hydrocarbons of the fluid; and reinjecting, from within the well, the separated water such that the separated water is not produced to the surface from which the well extends.

Another definition of the method of managing fluid flow in a well in accordance with the present invention comprises generating electricity in the well and operating a pump in the well with the electricity.

The present invention also provides a system for managing fluid flow in a well, comprising: a first set of packers in the well to define a first zone; a first flow control device, the first flow control device disposed between the first set of packers in the well, the first flow control device having a body in which an opening is defined between an annulus outside the body and a flow channel inside the first flow control device, and the first flow control device also having a rotor and a plurality of electromagnetic members such that the rotor and electromagnetic members of the first flow control device selectively operate together as either a generator or a pump; a second set of packers in the well to define a second zone; and a second flow control device, the second flow control device disposed between the second set of packers in the well, the second flow control device having a body in which an opening is defined between an annulus outside the body and a flow channel inside the second flow control device, and the second flow control device also having a rotor and a plurality of electromagnetic members such that the rotor and electromagnetic members of the second flow control device selectively operate together as either a generator or a pump.

Therefore, from the foregoing, it is a general object of the present invention to provide a novel and improved tool and method for managing fluid flow in a well. Other and further objects, features and advantages of the present invention will be readily apparent to those skilled in the art when the following description of the preferred embodiments is read in conjunction with the accompanying drawings.

DETAILED DESCRIPTION OF THE INVENTION

Figure 1:
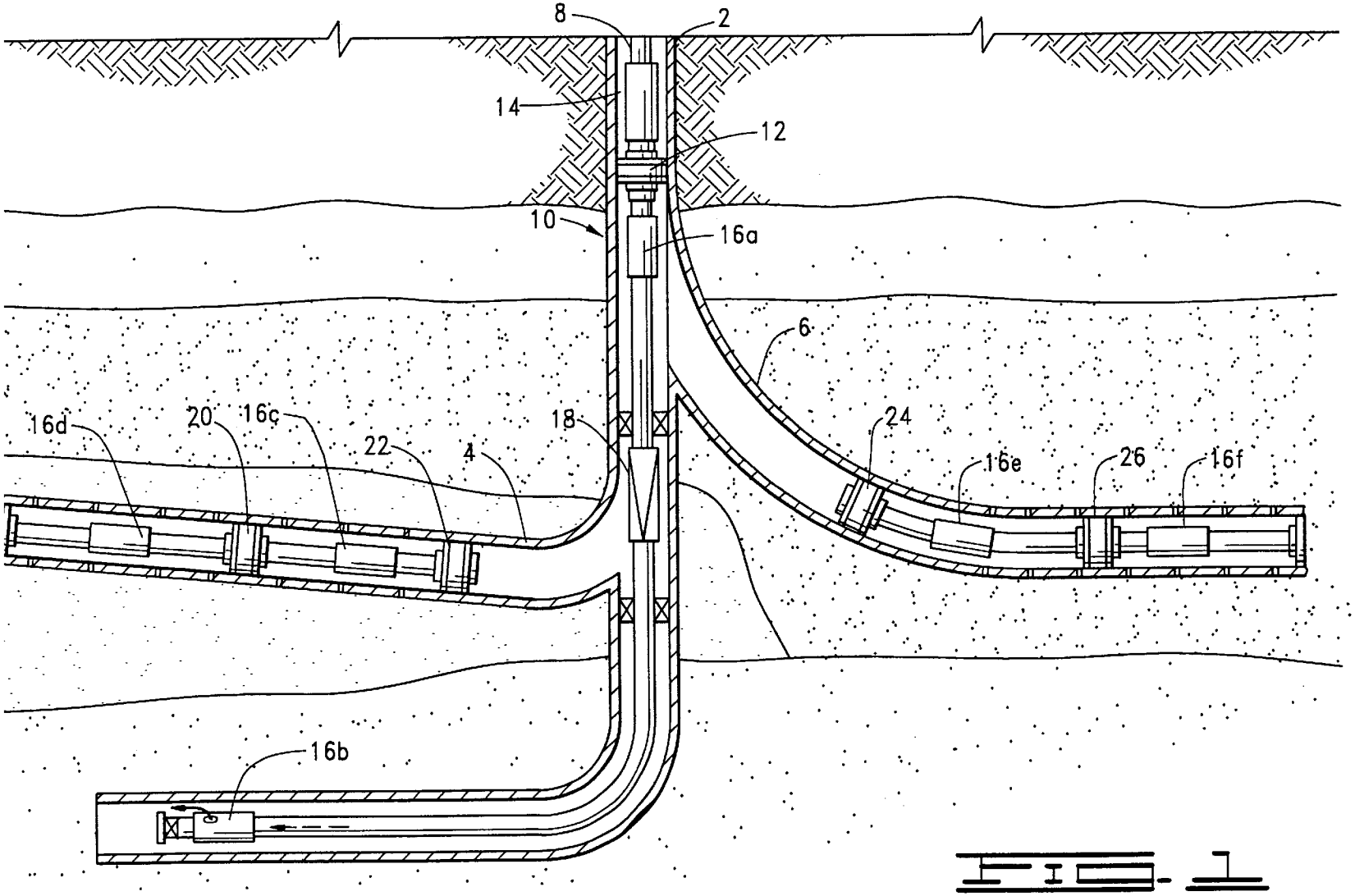
FIG. 1 illustrates a multi-lateral well in which the tool of the present invention is used.

A multi-lateral well illustrating one environment in which the present invention can be used is shown in FIG. 1. The well includes a main borehole 2 from which deviated or horizontal laterals 4 and 6 extend. In the illustration, the lateral boreholes 4, 6 are drilled into respective formations. The formation into which the lateral 4 extends contains hydrocarbons mixed with water, and the formation into which the lateral 6 extends has hydrocarbons without significant water.

The bottom of the main borehole 2 extends along a horizontal path into yet another formation which does not produce hydrocarbons but into which water can be injected for disposal.

The boreholes are drilled and completed in known manner and are not limiting of the present invention; however, the illustration of FIG. 1 provides a convenient way for explaining various aspects of the present invention. Further regarding the boreholes, they can be cased/lined or uncased/unlined as needed and fluid loss measures can be used as needed, all as known in the art; accordingly, none of these details as to the environment are further described or intended to be represented in any particular manner in the drawings.

Regarding the equipment illustrated in FIG. 1, this also is only illustrative of the present invention. It does, however, show one type of implementation for aspects of the method of the present invention.

Located in the main borehole 2 is a production string 8. The production string 8 connects to and communicates with a downhole production assembly 10.

The downhole production assembly 10 includes a packer 12 of a conventional type which is set in the borehole in known manner. The packer 12 seals the downhole production assembly 10 from the annulus 14 above the packer 12 and outside the production string 8.

The downhole production assembly 10 also includes a tool 16*a* of the present invention. In the environment illustrated in FIG. 1, the tool 16*a* meters hydrocarbon production from the lateral 6 into an axial flow channel communicating with the production string 8. Hydrocarbon production also flows into the tool 16*a* through the axial flow channel from the lateral 4.

The hydrocarbons from the lateral 4 enter the tool 16a after being separated from water through a separator 18. The separator 18 is of a conventional type (for example, a hydrocyclone separator). It operates in known manner to receive the entire fluid production from the lateral 4 and to separate the water from the hydrocarbons. The hydrocarbons flow up through the downhole production assembly 10 and specifically into the axial flow channel of the tool 16*a* for production to the surface through the production string 8. The water separated by the separator 18 flows down through the illustrated tubing disposed in the main borehole 2 for injection into the formation through a tool 16*b* of the present invention functioning as a pump.

The equipment located in the lateral 4 includes packers 20, 22 between which a tool 16*c* is connected. The tool 16*c* operates to meter production received from the formation between the packers 20, 22 out into the lateral 4 communicating with the separator 18.

Production into the lateral 4 is also received through a tool 16*d* receiving production from the formation to the left of the packer 20 as oriented in FIG. 1. The tools 16*c*, 16*d* act as meters to control the production of the formation fluids.

There is a similar structure in the lateral 6. This structure includes packers 24, 26 and tools 16*e*, 16*f*. These tools control the production of fluid from the adjacent formation into the main borehole 2 for communication through the tool 16*a* and into the production string 8.

Although the environment and structure illustrated in FIG. 1 are not limiting of the present invention, they do illustrate a method of the present invention. This method is one of managing fluid flow in a well and it comprises: producing a fluid from a subterranean formation into the well, which fluid includes hydrocarbons and water; separating, in the well, water from hydrocarbons of the fluid; and reinjecting, from within the well, the separated water such that the separated water is not produced to the surface from which the well extends. This is implemented in FIG. 1 by the equipment shown in lateral 4, the separator 18 and the tool 16*b*.

Another aspect of the method is that reinjecting the separated water can be performed by generating electricity in the well, such as by using the tools 16*c*, 16*d*, 16*e* or 16*f* in a manner described below and by operating the tool 16*b* as a pump in the well with the electricity to pump the separated water. That is, any one or more of the tools 16*a*, 16*c*, 16*d*, 16*e*, 16*f* can be used to generate electricity, and that electricity can be used to drive the tool 16*b* in a pump mode. If needed, this electricity can be augmented by other power sources, such as from one or more sources at the surface; and, of course, electricity can be totally supplied by other sources in other applications of the tool of the present invention.

The illustration of FIG. 1 also shows that the present invention provides a system for managing fluid flow in a well, which system includes multiple sets of packers in the well to define respective production zones and multiple respective flow control devices, at least one of each such tool being disposed between a respective set of packers to control flow either into or out of the formation.

Details of the tool 16 of the present invention and of the method of the present invention will be further described with reference to the remaining drawings.

Each of the tools 16*a*–16*f* is identical in the illustrated embodiment; however, each can be individually used as a valve or choke, a metering device, a generator or a pump. Thus, each tool 16 is an integrated tool providing a single unified structure but which can be operated in any of several different modes of operation. Broadly, each tool 16 is a flow control device that can be used to control flow in either direction between the annulus or other region outside the tool and an axial flow channel which is always open through the inside of the tool. Each tool can also function as an electric generator.

The preferred embodiment of the tool 16 will next be described with reference to FIGS. 2 and 3.

Each tool 16 has an outer body 28. The preferred embodiment of the outer body is a cylindrical sleeve having an opening 30, or port, defined through the sleeve. There can be one or more such openings. In the illustrated embodiment, such multiple openings would typically be disposed around the same circumference of the sleeve; however, openings can be disposed along the length of the sleeve as well if the interior structure is suitably modified to provide opening and closing control of the various ports.

The outer body 28 acts as a stator in that in the illustrated embodiment it is connected into a production string or other equipment which is relatively fixed within the borehole or which otherwise is used as a reference for other actions of the tool 16 described below.

The outer body 28 (and other parts of the tool) can be made of any suitable material, such as metal, plastic or ceramic capable of withstanding the pressures, temperatures and substances downhole. The material for the outer body 28 is machined or formed to have a desired shape and size and one or more inner diameters as needed to accommodate other components of the tool. For example, the outer body 28 has interior cavities 32, 34 and 36 for purposes to be described below.

The tool 16 also includes a flow control body 38, the positions of which control fluid flow or prevent fluid flow through the port(s) 30. The flow control body 38 is disposed in the outer body 28 such that the flow control body 38 is moveable between a closed position blocking the openings 30 (FIG. 2) and an open position unblocking the openings 30. The term "unblocking" as used in this description and the claims encompasses partially open and fully open states (FIG. 3 shows fully open state).

In the illustrated preferred embodiment, the flow control body 38 is an annular body made of a suitable material providing for a bearing seal as between the body 38 and the body 28 (e.g., metal-to-metal for low pressure differential applications). The height of the annular body is sufficient to overlie the openings 30 when the openings are closed.

The flow control body 38 is used in the valve or choke function. It can be positioned to close the ports 30, fully open them, or limit them somewhere in between. Preferably, the flow control body 38 can be moved throughout a continuum between fully closed and fully opened. This last feature of a continuum of openness or closedness enables the preferred embodiment to provide metering. Metering is used both with regard to controlling flow rate through the openings 30 as well as providing a signal responsive to the actual flow rate. This sensing feature is implemented in part in the preferred embodiment by a rotor 40.

Figure 2:
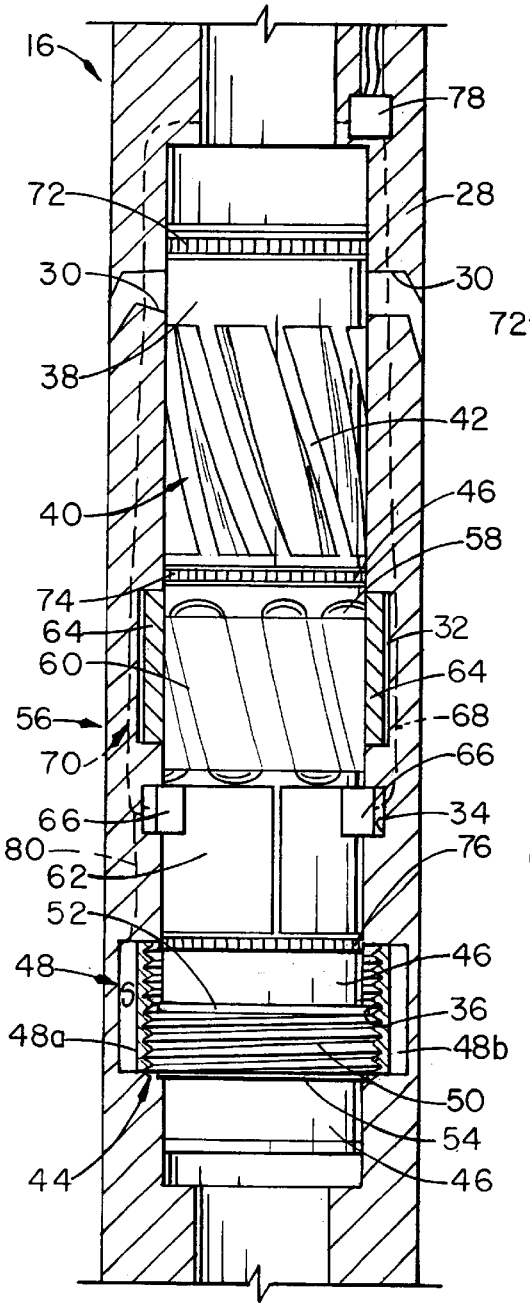
FIG. 2 is a sectional view of a preferred embodiment of the tool of the present invention.
Figure 3:
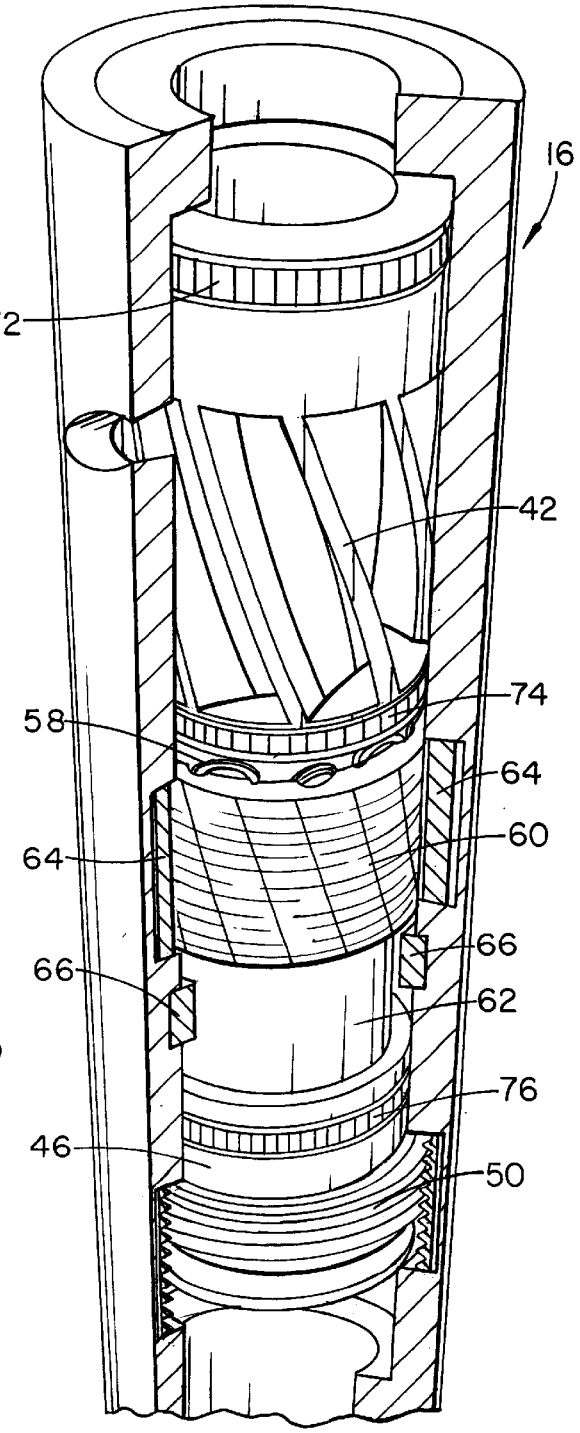
FIG. 3 is a perspective view of the tool illustrated in FIG. 2.

One rotor 40 is illustrated in the embodiment of FIG. 2; however, more than one rotor can be used (e.g., stacked rotor flow tubes). Other variations can also be implemented (e.g., longer flow tubes and other variations in size, different angles of turbine vanes (which vanes are described below), multiple stacked turbine vanes, etc.).

The rotor 40 provides an interface with the fluid whereby the rotor is driven by or drives the fluid relative to fluid flow through the openings 30. The rotor 40 is used to convert fluid flow to mechanical power or vice versa.

The rotor 40 is connected to the flow control body 38. This connection is such that as the flow control body 38 opens the ports 30, either flow into (or out of) the ports 30 impinges the rotor to rotate it or fluid pumped by the rotor is communicated through the ports 30. In one embodiment, the connection between the rotor 40 and the flow control body 38 is such that both move linearly and rotate together. In another embodiment, joint linear movement occurs but the rotor 40 can rotate relative to the flow control body 38 (e.g., by a sealed bearing coupling).

The rotor 40 has two degrees of motion. It can rotate about its longitudinal axis as referred to above. The rotor 40 can also move linearly or axially within the outer body 28. In the illustrated preferred embodiment, this linear movement occurs simultaneously with and in conjunction with the longitudinal movement of the flow control body 38. As illustrated in FIG. 2, the flow control body 38 and the rotor 40 are linearly disposed and adjoin each other within the outer body 28.

The rotor 40 of the illustrated preferred embodiment has a cylindrical squirrel cage configuration comprising a plurality of angled vanes 42 circumferentially spaced such that spaces are between the vanes to permit radial fluid flow between the inside and the outside of the rotor 40 and such that an axial channel is defined through the rotor to permit axial flow through it as well as through the tool 16.

The rotor 40 is used to provide other features of the preferred embodiment, namely the generator and the pump. In the generator function, the rotor is rotated by fluid flowing into or out of the tool 16 through open ports 30. The resulting mechanical power of the rotor 40 is used to generate electricity as explained further below.

In the pump mode, the rotor 40 is rotated electromagnetically to pump fluid either in through the ports 30 from outside the tool 16 or, by being rotated in the opposite direction, to pump fluid from the axial flow channel of the tool 16 out through the ports 30.

As mentioned above, the rotor 40 and the flow control body 38 are connected such that they can be moved linearly within the outer body 28. In the preferred embodiment illustrated in FIG. 2, this movement is caused by an actuator 44. Preferably, the actuator 44 is able to linearly move the flow control body 38 and the rotor 40 to variably adjust the opening of the ports 30 to provide "infinite" flow control (i.e., control throughout the continuum between fully closed and fully opened).

The actuator 44 is mounted on the sleeve of the outer body 28 and is coupled to a mandrel 46 linking the actuator 44 with the rotor 40. Operation of the actuator 44 moves the mandrel 46, the rotor 40 and the flow control body 38 axially within the sleeve 28 to displace the flow control body 38 and the rotor 40 relative to the openings 30.

In one implementation, the actuator 44 includes a motor 48 mounted in the cavity 36 of the sleeve of the outer body 28. The motor 48 includes a rotating element 48a having a threaded inner surface which engages a threaded outer surface of a ring 50 axially fixed by retaining rings 52, 54 relative to linear movement of the mandrel 46 but rotatively coupled on the mandrel such that the mandrel 46 can rotate inside the ring 50. To obtain axial movement, the ring is maintained (e.g., fixed or by clutch, such as electromagnetic or magnetic, that sets the relative movement relationship between the ring 50 and the motor 48) rotationally stationary relative to the motor 48 element so that energized stator 48*b* —driven rotation of the motor 48 element drives the ring 50 and the mandrel 46 up or down; however, preferably disengagement or other stoppage is provided for at limits of travel.

Another way to actuate the linear movement inside the outer body 28 is by manually shifting it with something external to the tool 16. For example, a separate downhole shifter can be connected to either end of the inner assembly of the tool 16 and operated to mechanically pull or push the inner assembly. Linear actuation can also occur in response to surface actions such as through a connecting wireline, slickline, coil tubing or other pipe or tubing string, for example.

When the actuator 44 has moved the flow control body 38 to an open position, operation of an electromagnetic assembly 56 of the preferred embodiment illustrated in FIG. 2 becomes effective. The assembly 56 provides an electrical interface which converts mechanical power to electricity or vice versa. In one operating state, the electromagnetic assembly 56 generates electricity in response to fluid-induced rotation of the rotor 40; and in another operating state, the electromagnetic assembly 56 rotates the rotor 40 in response to electricity applied to the electromagnetic assembly 56.

The electromagnetic assembly 56 includes the mandrel 46 that provides a support for a plurality of electrical windings 58, a plurality of pole pieces 60 and a commutator 62, which are also part of the electromagnetic assembly.

The mandrel 46 of the preferred embodiment is a sleeve having an axial flow passage defined through it. The mandrel 46 is connected to the rotor 40; in the illustrated embodiment the mandrel and the rotor are integral and unitary, being constructed with the same tubing piece. The mandrel 46 is also coupled to the actuator as described above.

The plurality of electrical windings 58 are wound on the mandrel 46. The plurality of pole pieces 60 are disposed radially outwardly of the windings 58 so that the pole pieces overlie the windings 58.

The commutator 62, or brush ring, is mounted on the mandrel 46. The commutator 62 is connected to the electrical windings in known manner so that one end of the windings is connected to one (or more electrically parallel) segments of the commutator 62 and the other end of the winding is connected to another (or more electrically parallel) segments of the commutator 62. The commutator 62 is made of suitable electrically conductive material.

The electromagnetic assembly 56 also includes a plurality of magnets 64 mounted on the outer body 28 such that the magnets 64 interact with electromagnetic fields generated with the electrical windings 58. In the illustrated preferred embodiment of FIG. 2, the magnets 64 are disposed around an inner circumference defined by the cavity 32 of the sleeve of the outer body 28. The position of the cavity 32, and thus of the magnets within the cavity 32, is such that the magnets 64 and the pole pieces 60 are substantially aligned throughout the linear travel of the inner assembly of the tool 16.

The electromagnetic assembly 56 also includes a plurality of contacts 66 mounted on the outer body 28. In the illustrated embodiment, the contacts 66 are electrically conductive members referred to as brushes disposed in the cavity 34 such that the brushes overlie and engage respective segments of the commutator 62. The contacts 66 provide the interface to external wires 68, 70. Electricity generated by the present invention is communicated over the wires 68, 70. This electricity can be used for sensing flow and for providing output power. The contacts 66 also provide the interface through which power is input to the commutator 62 and the windings 58 when the tool 16 is driven in the pump mode.

The electrical contacts 66 are disposed around an inner circumference of the sleeve 28 such that the brushes are spaced longitudinally from the magnets 64. At least one brush contacts one section of the commutator connected to one end of the windings 58, and at least another contact brush 66 contacts a different section of the commutator 62 connected to the other end of the windings 58.

The brushes 66 and the commutator 62 are sized sufficiently so that electrical contact is made throughout the linear movement of the inner assembly of the tool 16.

To keep the fluid within the rotor section of the inner assembly and to isolate the electrical components of the electromagnetic assembly 56 from the fluid, the preferred embodiment of the tool 16 illustrated in FIG. 2 includes three seals. An O-ring seal 72 is mounted in a groove defined around an end of the flow control body 38 opposite the end of the flow control body connected to the rotor 40. This places the O-ring seal 72 on one side (above in the orientation of FIG. 2) of the openings 30. The seal 72 seals between the flow control body 38 and the inner surface of the outer body 28.

An O-ring seal 74 is mounted in a groove of the mandrel 46 near the juncture of the rotor 40 and the mandrel 46. The seal 74 seals between the mandrel 46 and the inner surface of the outer body 28 between the cavity 32 and the ports 30. This places the seal 74 below the openings 30, and thus on the opposite side of the openings 30 from the seal 72, for the orientation shown in FIG. 2.

A third O-ring seal 76 is mounted in a groove on the mandrel 46 between the commutator 62 and the upper retaining ring 52 of the actuator 44. This provides a seal against the inner surface of the outer body 28 between the cavities 34, 36.

The tool 16 can be operated remotely and it can provide generated electricity remotely; however, the illustrated embodiment of FIG. 2 has an on-board controller 78 housed within the body of the sleeve of the outer body 28. The controller 78 is of any suitable type to provide the necessary control and signal process associated with the operation of the tool 16. One implementation can include a microprocessor; however, other types of digital or analog controllers can be used.

Regardless of the specific controller used, in the preferred embodiment the controller 78 receives electricity from the wires 68, 70 (and any others used with additional contact brushes 66). A characteristic (e.g., magnitude, frequency) of this electricity can be correlated to flow rate through the openings 30 that generates the sensed electricity, and thereby indicate the size of the orifice defined by the degree of openness of the ports 30. The controller 78 can also provide for power conversion (e.g., transformer, alternating current to direct current conversion) and energy storage (e.g., battery recharging).

The controller 78 can also contain suitable electrical sources (e.g., batteries) and drive circuitry for energizing the windings 58 to drive the rotor 40 as a pump, or such energization can come from an external source.

In addition to the foregoing, the tool 16 can include or be used with other equipment, such as pressure and temperature sensors.

As mentioned above, the tool 16 can be used in either a generator mode or a pump mode to manage fluid flow in a well, such as the well illustrated in FIG. 1.

Operating the flow control device 16 in the generator mode includes at least partially unblocking the openings 30 in the flow control device such that fluid in the annulus outside the device 16 flows through the openings 30 into the flow channel inside the flow control device (or vice versa). This is performed in the illustrated preferred embodiment tool 16 by operating the motor 48 to move the ring 50 linearly. This moves the rotor 40 and the electromagnetic members axially within the body of the flow control device.

Operation of the motor 48 occurs through the controller 78 connected by electrical conductor cable 80 (FIG. 2) in the illustrated preferred embodiment. The controller 78 can have an internal timer by which it is programmed to respond in preset hardware or software implemented time intervals; or an external signal of any suitable and detectable type (e.g., acoustic, pressure, electromagnetic, radioactive, mechanical) can be applied to cause the controller 78 to turn the motor 48 on and off. Feedback can be provided through the metering function of the present invention in that as the motor 48 shifts the inner assembly of the tool 16, the controller 78 can monitor the resulting electricity that is generated in response to fluid flow through the rotor 40. When the electrical signal indicates the desired electrical parameter or flow rate is being achieved, the motor 48 can be de-energized to stop the linear movement of the inner assembly of the tool 16.

Thus, additional aspects of operating the flow control device 16 in a generator mode include driving the rotor 40 of the flow control device with the flowing fluid, rotating the plurality of electromagnetic members with the rotor 40 such that electricity is generated, and conducting the electricity from the flow control device. This last step is achieved using the commutator 62, the contact brushes 66, and the wires 68, 70 in the illustrated embodiment.

The generator mode can also include sensing the generated electricity to determine a fluid flow parameter of fluid flowing through the opening. That is, as the electricity is generated, the controller 78 senses it through the conductors 68, 70 and determines the correlation between the electricity that has been generated and the flow rate, for example. This can be by way of a look-up table in the controller 78, a mathematical formula that is used in a software implemented computation, or whatever technique is suitable to correlate the electrical signal with the flow rate of the fluid or the position of the flow control body 38. This provides the feedback signal referred to above in controlling how far the motor 48 axially moves the inner assembly of the tool 16. Thus, operating in the generator mode can also include controlling the step of at least partially unblocking the opening in the flow control device in response to the sensed electricity.

Operating the flow control device 16 in the pump mode includes at least partially unblocking the openings 30 in the flow control device so that pumping can occur in either direction between inside and outside of the outer body 28 of the tool 16. The pump mode further includes conducting suitable electricity to the flow control device. This is provided through wires 68, 70 and brushes 66 in the illustrated embodiment. The plurality of electromagnetic members are rotated in response to the electricity, and the rotor 40 is driven with the rotating electromagnetic members such that the driven rotor pumps fluid between (i.e., in one direction or the other) the interior flow channel of the tool 16 and the outer annulus outside the tool 16. The electricity can be controlled such that the rotor 40 can be rotated in either a clockwise or a counterclockwise direction. In one direction, the rotor 40 pumps fluid from inside the tool 16 out through the open ports 30 into the annulus. This can be used to pump fluid back into the formation such as with the tool 16*b* in FIG. 1. If the rotor is rotated in the other direction, pumping occurs from the annulus, through the ports 30, into the axial flow channel of the tool 16. This can be useful such as in drawing down the adjacent formation.

Another aspect of the operation of the present invention is in moving the flow control body, the rotor, and the electromagnetic members together to selectively block or unblock the opening. As explained above, these are moved together axially within the outer body 28 of the illustrated tool 16. The axial movement occurs in response to any suitable force which can be internally generated or externally applied. Regarding the former, the motor 48 can be energized to drive the inner assembly up and down within the sleeve of the outer body 28. Movement can also occur by applying to the inner assembly a longitudinal mechanical force originated outside such as via an external linear actuator or a surface coupling as described above.

The linear or axial movement of the inner assembly can occur in either direction so that the ports can be opened or closed. This movement can also be used within any one tool in conjunction with either generating electricity or providing a pumping function as described above. That is, any one tool 16 can be used as a valve or choke, a meter, a generator or a pump.

Thus, the present invention is well adapted to carry out the objects and attain the ends and advantages mentioned above as well as those inherent therein. While preferred embodiments of the invention have been described for the purpose of this disclosure, changes in the construction and arrangement of parts and the performance of steps can be made by those skilled in the art, which changes are encompassed within the spirit of this invention as defined by the appended claims.

What is claimed is:

1. A combination flow control/generator/pump tool for a well, comprising:

an outer body having an opening defined in a side wall of the body;

a flow control body disposed in the outer body such that the flow control body is movable between a closed position blocking the opening in the outer body and an open position unblocking the opening in the outer body; and a rotor connected to the flow control body and disposed in the outer body such that the rotor can rotate within the outer body in selectable response either to a force applied to the rotor by fluid flowing through the opening and relative to the rotor or to an electromagnetic force coupled to the rotor such that the tool generates electricity in response to the force applied by the flowing fluid and such that the tool pumps fluid through the rotor in response to the electromagnetic force.

2. A tool as defined in claim 1, wherein the rotor moves in response to movement of the flow control body between the closed position and the open position.

3. A tool for a well, comprising:

an outer body having an opening defined in a side wall of the body;

a flow control body disposed in the outer body such that the flow control body is movable between a closed position blocking the opening in the outer body and an open position unblocking the opening in the outer body;

a rotor connected to the flow control body and disposed in the outer body such that the rotor can rotate within the outer body in response to a force applied to the rotor; and an actuator disposed in the outer body to move the flow control body linearly between the closed position and the open position.

4. A tool as defined in claim 3, wherein the rotor moves linearly with the flow control body.

5. A tool as defined in claim 4, wherein the flow control body rotates with the rotor.

6. A tool as defined in claim 3, wherein the outer body, the flow control body, the rotor, and the actuator define an axial flow channel through the tool.

7. A tool as defined in claim 3, wherein:

the flow control body and the rotor are linearly disposed within the outer body; and the tool further comprises:

a first seal, the first seal disposed adjacent an end of the flow control body opposite the rotor; and a second seal, the second seal disposed adjacent an end of the rotor opposite the flow control body.

8. A tool as defined in claim 1, wherein the outer body, the is flow control body, and the rotor define a flow channel through the tool.

9. A tool for a well, comprising:

an outer body having an opening defined in a side wall of the body;

a flow control body disposed in the outer body such that the flow control body is movable between a closed position blocking the opening in the outer body and an open position unblocking the opening in the outer body;

a rotor connected to the flow control body and disposed in the outer body such that the rotor can rotate within the outer body in response to a force applied to the rotor; and an electromagnetic assembly having an operating state wherein the electromagnetic assembly generates electricity in response to fluid-induced rotation of the rotor.

10. A tool as defined in claim 9, wherein the electromagnetic assembly has another operating state wherein the electromagnetic assembly rotates the rotor in response to electricity applied to the electromagnetic assembly.

11. A tool as defined in claim 9, wherein:

the electromagnetic assembly includes a support connected to the rotor, a plurality of electrical windings mounted on the support, and a commutator mounted on the support and connected to the electrical windings; and the tool further comprises an actuator coupled to the support to move the support, the rotor, and the flow control body linearly within the outer body.

12. A tool as defined in claim 11, wherein the electromagnetic assembly further includes;

a plurality of magnets mounted on the outer body such that the magnets interact with electromagnetic fields generated with the electrical windings; and a plurality of contacts mounted on the outer body in engagement with the commutator.

13. A tool as defined in claim 12, wherein the electromagnetic assembly has another operating state wherein the electromagnetic assembly rotates the rotor in response to electricity applied to the electromagnetic assembly.

14. A tool as defined in claim 13, wherein:

the flow control body, the rotor and the support are linearly disposed within the outer body; and the tool further comprises:

a first seal, the first seal disposed adjacent an end of the flow control body opposite the rotor; and a second seal, the second seal disposed between the rotor and the electrical windings on the support.

15. A tool as defined in claim 14, wherein the outer body, the flow control body, the rotor, and the support define an axial flow channel through the tool.

16. A tool as defined in claim 1, wherein:

the flow control body and the rotor are linearly disposed within the outer body; and the tool further comprises:

a first seal, the first seal disposed adjacent an end of the flow control body opposite the rotor; and a second seal, the second seal disposed adjacent an end of the rotor opposite the flow control body.

17. A tool as defined in claim 16, wherein the outer body, the flow control body, and the rotor define an axial flow channel through the tool.

* * * * *